US006570553B2

(12) United States Patent
Hashimoto et al.

(10) Patent No.: US 6,570,553 B2
(45) Date of Patent: May 27, 2003

(54) DISPLAY AND ITS DRIVING METHOD

(75) Inventors: Seiji Hashimoto, Kanagawa-ken (JP); Daisuke Yoshida, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/737,591

(22) Filed: Dec. 18, 2000

(65) Prior Publication Data

US 2001/0000662 A1 May 3, 2001

Related U.S. Application Data

(62) Division of application No. 08/457,781, filed on Jun. 1, 1995, now Pat. No. 6,295,043.

(30) Foreign Application Priority Data

Jun. 6, 1994 (JP) ..... 6-123647

(51) Int. Cl.[7] ..... G09G 3/36
(52) U.S. Cl. ..... 345/100; 345/209
(58) Field of Search ..... 345/88, 94, 96, 345/99, 100, 209; 348/795, 792, 589, 600, 607

(56) References Cited

U.S. PATENT DOCUMENTS

| | | | | |
|---|---|---|---|---|
| 5,091,784 A | | 2/1992 | Someya et al. | 358/183 |
| 5,122,790 A | | 6/1992 | Tasuda et al. | 345/96 |
| 5,172,249 A | | 12/1992 | Hashimoto | 358/482 |
| 5,341,151 A | | 8/1994 | Knapp | 345/88 |
| 5,365,284 A | | 11/1994 | Matsumoto et al. | 345/99 |
| 5,510,915 A | | 4/1996 | Ge et al. | 359/59 |
| 5,579,027 A | | 11/1996 | Sakurai et al. | 345/100 |
| 5,619,225 A | | 4/1997 | Hashimoto | 345/98 |
| 5,648,793 A | | 7/1997 | Chen | 345/94 |
| 5,883,609 A | * | 3/1999 | Asada et al. | 345/100 |
| 6,031,514 A | | 2/2000 | Hashimoto et al. | 345/94 |
| 6,072,457 A | | 6/2000 | Hashimoto et al. | 345/100 |

FOREIGN PATENT DOCUMENTS

| | | |
|---|---|---|
| EP | 0 295 802 | 12/1988 |
| EP | 0368572 | 5/1990 |
| EP | 0371665 | 6/1990 |
| EP | 0416550 | 3/1991 |
| EP | 0486284 | 5/1992 |
| JP | 63-144671 | 6/1988 |
| JP | 3-64179 | 3/1991 |
| JP | 3-94589 | 4/1991 |
| JP | 3-172085 | 7/1991 |
| JP | 5-210086 | 8/1993 |

* cited by examiner

*Primary Examiner*—Amare Mengistu
(74) *Attorney, Agent, or Firm*—Fitzpatrick, Cella, Harper & Scinto

(57) ABSTRACT

In a display having a case where an image signal is inputted to the same row of a display section at an odd field period and an even field period, even if an AC driving is performed, a problem of a deterioration of a device due to a burning of a liquid crystal of an image display section by inputting the image signal including a still image such as a character or the like. Therefore, the polarity of the image signal is inverted every field and the polarity is further inverted every arbitrary n frames. In the n-frame inversion, a 1-field inversion pulse like ϕFRP that is outputted from a control circuit is further converted to an arbitrary n-frame inversion pulse by using an inverter, a switch, a counter, and the like. Thus, a signal processing circuit converts the image signals (R, G, B) to image signals like FIG. 1B whose polarities are inverted every one field and n fields.

4 Claims, 15 Drawing Sheets

FIG. 2A

1-FIELD INVERSION SYSTEM

| 1ST FIELD | 2ND FIELD |
|---|---|
| + + + | − − − |
| + + + | − − − |
| ⋮ | ⋮ |
| + + + | − − − |
| + + + | − − − |

FIG. 2B

1 HOUR / FIELD INVERSION

| | |
|---|---|
| + + + | − − − |
| − − − | + + + |
| + + + | − − − |
| − − − | + + + |

FIG. 2C

DATA LINE / 1-FIELD INVERSION

| | |
|---|---|
| + − + | − + − |
| + − + | − + − |
| ⋮ ⋮ ⋮ | ⋮ ⋮ ⋮ |
| + − + | − + − |
| + − + | − + − |

FIG. 2D

1 BIT / 1-FIELD INVERSION

| | |
|---|---|
| + − + | − + − |
| − + − | + − + |
| ⋮ ⋮ ⋮ | ⋮ ⋮ ⋮ |
| + − + | − + − |
| − + − | + − + |

PRIOR ART

PRIOR ART

FIG. 13A
PRIOR ART

| | 1ST FIELD | 2ND FIELD | 3RD FIELD | 4TH FIELD |
|---|---|---|---|---|
| g1 | | + | | − |
| g2 | + | + | − | − |
| g3 | + | − | − | + |
| g4 | − | − | + | + |
| g5 | − | + | + | − |
| g6 | + | + | − | − |

FIG. 13B
PRIOR ART

| | 1ST FIELD | 2ND FIELD | 3RD FIELD | 4TH FIELD |
|---|---|---|---|---|
| g1 | | + | | + |
| g2 | + | − | + | − |
| g3 | + | − | + | − |
| g4 | − | + | − | + |
| g5 | − | + | − | + |
| g6 | + | − | + | − |

FIG. 13C
PRIOR ART

| | 1ST FIELD | 2ND FIELD | 3RD FIELD | 4TH FIELD |
|---|---|---|---|---|
| g1 | | + | | + |
| g2 | + | − | + | − |
| g3 | − | + | − | + |
| g4 | + | − | + | − |
| g5 | − | + | − | + |
| g6 | + | − | + | − |

PRIOR ART

PRIOR ART

PRIOR ART

DISPLAY AND ITS DRIVING METHOD

This application is a division of U.S. application Ser. No. 08/457,781, filed Jun. 1, 1995 now U.S. Pat. No. 6,295,043.

BACKGROUND OF THE INVENTION

1. Field of the Invention

The present invention relates to a display and its driving method and, more particularly, to a display for inputting an image signal of an AC voltage to each pixel and its driving method.

2. Related Background Art

In recent years, multimedia has become increasingly important and the amount of information that is handled in society has rapidly increased. In such a situation, in place of a CRT (Cathode Ray Tube), a thin type flat display as an interface from a computer to a human being has become an important device to widen the multimedia market. As flat displays, LCD (liquid crystal display), PDP (plasma display), and an electron beam flat displays are leading devices. Among them, the liquid crystal display is achieving a wider market in association with a widespread use of small personal computers. Among the liquid crystal displays, active matrix liquid crystal display has no crosstalk as compared with a simple matrix liquid crystal display of an STN (super twisted nematic) type or the like, so that the active matrix LCD has a large contrast over the whole picture plane. Such an active matrix LCD is, therefore, has attracted use as not only a display of the small type personal computer but also for use as a view finder of a video camera, a projector, and a thin type television.

Among active matrix liquid crystal displays there are TFT (thin film transistor) type displays and diode type displays. FIG. 10A is a block diagram of an image signal input of a TFT type image display. Reference numeral 10 denotes an image pixel section having pixels arranged in a matrix shape; 20 a vertical scanning circuit for selecting a display row; 30 a sampling circuit of a color image signal; and 40 a horizontal scanning circuit for generating a signal of the sampling circuit.

A unit pixel of the display pixel section 10 comprises a switching element 11, a liquid crystal material 15, and a pixel capacitor 12. In the case where the switching element 11 is a TFT (thin film transistor), a gate line 13 connects a gate electrode of the TFT and the vertical scanning circuit 20. A common electrode 21 of an opposite substrate commonly connects terminals of one side of the pixel capacitor 12 of all of the pixels. A common electrode voltage $V_{LC}$ is applied to the common electrode 21. When the switching element 11 is a diode (including a metal/insulator/metal element), a scan electrode is arranged in the lateral direction on the opposite substrate and is connected to the vertical scanning circuit 20. An input terminal of the switching element 11 is connected to the sampling circuit 30 by a data line 14 in the vertical direction. In the case where the switching element 11 is any one of the TFT and the diode, the vertical direction data line 14 connects the input terminal of the switching element 11 and the sampling circuit 30. An output terminal of the switching element 11 is connected to another terminal of the pixel capacitor 12.

A control circuit 60 separates an image signal to signals necessary to the vertical scanning circuit 20, horizontal scanning circuit 40, a signal processing circuit 50, and the like. The signal processing circuit 50 executes a gamma process considering liquid crystal characteristics, an inverting signal process to realize long life of the liquid crystal, and the like and generates color image signals (red, blue, and green) to the sampling circuit 30.

FIG. 10B is a detailed equivalent circuit diagram of the color-display pixel section 10 of the TFT type and the sampling circuit 30. The pixels (R, G, B) are arranged in a delta shape and the pixels of the same color are distributed to both sides of the data lines 14 (d1, d2, . . . ) every row and are connected to the data lines (d1, d2, . . . ). The sampling circuit 30 is constructed by switching transistors (sw1, sw2, . . . ) and a capacitor (a parasitic capacitance of the data lines 14 and a pixel capacitance). An image signal input line 16 is constructed by signal lines only for R, G, B colors. The switching transistors (sw1, sw2, . . . ) sample the color signals of the image signal input line 16 in accordance with pulses (h1, h2, . . . ) from the horizontal scanning circuit 40 and transfer the color signals to the pixels through the data lines 14 (d1, d2, . . . ). Pulses (ϕg1, ϕg2, . . . ) are transmitted from the vertical scanning circuit 20 to TFT gates of the pixels and rows are selected, thereby writing the signals to the pixels. As mentioned above, the pulses (ϕg1, ϕg2, . . . ) turn on the TFTs 11 included in the rows, so that an image signal of one horizontal scan of each corresponding row is written to all of the pixels included in the rows. The image signal of one horizontal scan is called a 1H signal hereinbelow.

FIG. 11A shows an example of an interlace scan of a liquid crystal display having rows of the same number as that of the vertical scanning lines of an image signal for a CRT type television based on the NTSC or the like. In the liquid crystal display, when the 1H signal is written to two rows, to decrease flickering of a moving image, 2-row simultaneous driving or a 2-row interpolation driving (signal writing corresponding to the pixels arranged in a delta shape) which is treated similarly to the 2-row simultaneous driving, is often executed. In those driving methods, a combination of two rows to be selected is changed in accordance with the odd field and the even field. In the following description, it is assumed that the rows on the display pixel section which are selected and to which information is written are designated by symbols (g1, g2, . . . ) of vertical scanning pulses. In the odd field, the 1H signal of a horizontal scan line odd1 is written to the rows g2 and g3. Similarly, the 1H signal of odd2 is written to the rows g4 and g5. Each of the 1H signals of odd3 and subsequent horizontal scan lines is also similarly written for every two rows. On the other hand, in the even field, a combination of rows to be selected is deviated from the odd field by one row and the 1H signal of a horizontal scan line even1 is written to the rows g1 and g2. Similarly, the 1H signal of even2 is written to the rows g3 and g4 and each of the subsequent signals is also similarly written for every two rows.

FIG. 12 shows a timing chart of scan pulses of the 2-row simultaneous driving. In the odd field, the vertical scan pulses fg2 and fg3 are set to the "H" level. The TFT corresponding to each of the pixels of the rows is turned on, thereby writing the 1H signal of odd1 to the rows g2 and g3. In this instance, for the "H" period of the horizontal scan pulses (h1, h2, . . . ), the image signal sampled by the sampling circuit is written to the pixels of the rows g2 and g3. A similar writing operation is also executed in the scan of odd2 and subsequent lines.

FIG. 11B shows an example of the interlace scan of a liquid crystal display having rows of the number that is ½ of the number of vertical scan lines of the image signal for the CRT type television based on the NTSC or the like. In this case, the rows to be selected on the display pixel section are also shown by the symbols (g1, g3, . . . ) of the horizontal scan pulses. In the odd and even fields, the 1H signal is written to the same row. In the odd field, the 1H signal of the horizontal scan line odd1 is written to the row g2 and the 1H signal of odd2 is written to the row g4. Similarly, each of the 1H signals of odd3 and subsequent lines is also written. In the even field as well, the 1H signal of even1 is written to the row g2 and the 1H signal of even2 is written to the row g4. Each of the subsequent signals is also similarly written by using rows (g4, g8, . . . ) to which the information was written in the odd field. A timing chart of the scan pulse shows a scan by the 2-row simultaneous driving shown in FIG. 12 without the odd row pulses (φg3, φg5, . . . ).

In the liquid crystal display, when a predetermined voltage is applied to a liquid crystal material for a long time, a burning phenomenon may occur such that quality of the liquid crystal material is diminished. Therefore, the image signal is written from the reference potential by the positive or negative polarity, thereby executing an AC driving in which the polarities of the image signal are exchanged. When an exchanging period of the signal polarities is long, a flickering that is visibly recognized by the eyes of a human being appears. FIG. 13A shows signal polarities of the selected rows in the 2-row simultaneous driving. A case where the voltage of the image signal is positive for the common electrode voltage as a reference potential is expressed by "+" and a case where it is negative is expressed by "-". Each field scan period is shown in the lateral direction. A selected row is shown in the vertical direction. The signal polarities are exchanged every horizontal scan. In this case, when attention is paid to one selected row (for example, row g2), the signal polarities are inverted every two fields. Therefore, a line flicker of 30 Hz of ½ of the scan period (60 Hz) of one field occurs and becomes a flickering of the display. As the frequency of the flicker is low, the flicker is recognized to the human eyes and becomes conspicuous. Particularly, when the flicker period decreases to 50 Hz or less, it is seen as a flicker to the human eyes. Therefore, there is an example such that the signal polarity of each row is inverted every field and the flicker period is set to 60 Hz. FIG. 13B shows the 2-row simultaneous driving in which the signals of the same polarity are written in the odd fields and the signals of different polarities are written in the even fields and the signal polarities are exchanged every field when an attention is paid to any row. In this case, the flicker period is set to 60 Hz and is hard to be recognized to the human eyes.

In AC driving, flicker is made inconspicuous by reducing the writing period of the signal to the pixel. However, a case exists where even if the writing period is set to the shortest period, when still information such as a character or the like is displayed for a long time, burning of the liquid crystal material occurs. For example, the case where the whole picture plane is displayed in black by the 2-row simultaneous driving and only a certain portion is displayed in white will now be considered. First, attention is paid to an example of the scan when an NTSC signal is displayed at a high fidelity to a CRT television or a display that is almost equivalent thereto. FIG. 14 shows an example of such a scan. In FIG. 14, scan lines even2, odd2, and even3 denote 1H signals of the white display and the other scan lines indicate black display signals (the signals of the black display are omitted). Since those displays display the original image signal as it is at a high fidelity, by performing AC driving, even if a still image is displayed, there is no fear of occurrence of the burning of the liquid crystal material.

FIG. 15A shows an example of a scan when the same NTSC signal is displayed by the 2-row simultaneous driving. In the odd field, the 1H signal (original signal o2, pseudo signal o'2) of odd2 is written to the rows g4 and g5. In the even field, the 1H signal (original signal e2, pseudo signal e'2) of even2 is written to the rows g3 and g4. The 1H signal (original signal e3, pseudo signal e'3) of even3 is written to the rows g5 and g6. In this instance, the signal which is inverted every field is written to each row. FIG. 15B shows a signal voltage waveform of each row. The upper side than the reference potential ($V_{LC}$) shows an odd field period of FIG. 15A. The lower side shows an even field period. The rows in which the white display signal was written in the odd field period are only the rows g4 and g5. The rows in which the white display signal was written in the even field period are the four rows g3, g4, g5, and g6. In this instance, the rows g3 and g6 are displayed in black in the odd field and are displayed in white in the even field. Namely, the voltages of the hatched portions remain as DC voltages in the liquid crystal. When such a state is left for a long time, even if AC driving is executed, there is a fear of occurrence of burning of the liquid crystal material.

FIG. 16A shows an example of a scan when the NTSC signal is displayed by a liquid crystal display in which the number of rows is only ½ of the number of scan lines of the signal as described in FIG. 5. The 1H signal of odd1 and the 1H signal of even1 are written to the same row g2 and the signals of odd2 and even2 are written to the same row g4. The signals are subsequently written in a manner similar to the above. even2, odd2, and even3 show white display signals and the other scan lines show black display signals. FIG. 16B shows a signal voltage waveform of each row. In this case as well, in the row g6, the voltage of the hatched portion remains as a DC voltage in the liquid crystal and if such a state is left for a long time, there is a fear of occurrence of burning of the liquid crystal material. Even in the plasma display, electron beam flat display, and electroluminescence display, there is a case where the devices are deteriorated such that the electrodes are corroded or the like in DC driving, so that there is a case where the AC driving is performed. Consequently, in a manner similar to the liquid crystal display as described above, when a still image is inputted, even if the AC driving is executed, the DC voltage remains and there is a fear of deterioration of the device.

To solve the above problems, there is a liquid crystal display such that a television signal which handles a motion image is 2-line simultaneous interlace driven and a still image such as character information or the like is 2-line simultaneous non-interlace driven (Japanese Laid-Open Patent Application No. 3-94589). However, in such a liquid crystal display, if there is a still image portion in the television signal, a burning occurs. To prevent it, it is necessary to use a frame memory, a motion detecting circuit, or the like to judge whether the image is a motion image or a still image, so that the apparatus becomes very complicated and expensive.

SUMMARY OF THE INVENTION

In consideration of the above problems, it is a subject of the invention to provide a display which does not cause burning even when a still image signal such as a character or the like is inputted, by adding a simple circuit.

The present inventors made efforts to solve the above subject, and the following invention was obtained. That is, according to the invention, there is provided a display having a case where an image signal is inputted to the same row in an odd field period and an even field period, wherein the display has means for inverting a polarity of the image signal every field and, further, for inverting the polarity every arbitrary frames. The invention also incorporates the invention of a driving method of the display. That is, according to the invention, there is provided a driving method of a display having a case where an image signal is inputted to the same row in an odd field period and an even field period, wherein a polarity of the image signal is inverted every field and, further, the polarity is inverted every arbitrary frames.

The n-frame inversion can be realized by further converting the 1-field inverting pulse of 1H such as ϕFRP to an arbitrary n-frame inverting pulse by using an inverter 51, a switch 52, a counter 53, and the like as shown in FIG. 1A. FIG. 1B shows a timing chart of the polarity of an image signal that is inputted to a certain element in the display of the invention when paying an attention to such an element. While the polarity of the image signal that is inputted to the element is inverted every field, the polarity is also inverted for a period of a further large n-frame. The value of (n) is preferably set to an integer. However, it is also possible to set the value of (n) to a small number so long as the polarity inversion of a large period occurs in a writing period of one field. It is desirable that an arbitrary n-frame inversion is performed in a range where it is not perceived by the human eyes. Since the ordinary liquid crystal is burned for a time interval from a few minutes to a few hours, it is sufficient to invert the polarity within such a range. For example, it is desirable to execute such an arbitrary frame inversion at a period of time from 0.13 second (7.5 Hz) to 60 minutes, more preferably, from one second (1 Hz) to one minute.

FIGS. 2A to 2D show field inverting systems to which the invention can be applied. In the diagram, FIG. 2A shows a 1-field inverting system, FIG. 2B a 1H/1-field inverting system, FIG. 2C a data line/1-field inverting system, and FIG. 2D a bit/1-field inverting system. In the invention, in addition to those inverting systems, the polarity is further inverted at arbitrary n frames.

The invention can be also applied to any displays such that even the AC driving is performed, the DC component remains in the image signal inputted to the pixel. For example, as such displays, there are a liquid crystal display, a plasma display, an electron beam flat display, an electroluminescence display, and the like.

In the invention, since the DC components such as rows g3 and g6 in FIG. 15B or the row g6 in FIG. 16B are exchanged every n frames, the liquid crystal is not burned. In case of using the liquid crystal display as a display of the invention, since a still image signal which became the DC component hitherto is inverted at a period larger than the field, the liquid crystal material is not burned. When the display of the invention is either one of the plasma display, electron beam flat display, and electroluminescence display, since the still image signal which became the DC component hitherto is inverted at a period larger than the field, the element is not deteriorated. Therefore, a display with a high reliability can be provided for a long time.

BRIEF DESCRIPTION OF THE DRAWINGS

FIGS. 2A to 2D show examples of inverting systems;

FIGS. 13A to 13C show examples of signal polarities on the display;

DETAILED DESCRIPTION OF THE PREFERRED EMBODIMENTS

[Embodiment 1]

Figure 1A:
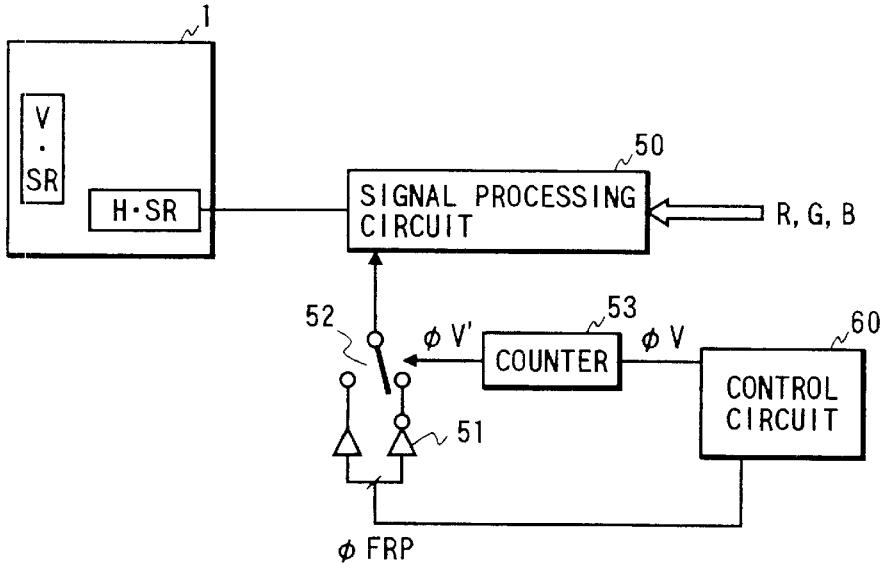
FIGS. 1A and 1B show block diagrams FIG. 1A of a circuit to execute an n-frame inversion of the invention and an image signal FIG. 1B constructed by n frames.
Figure 1B:
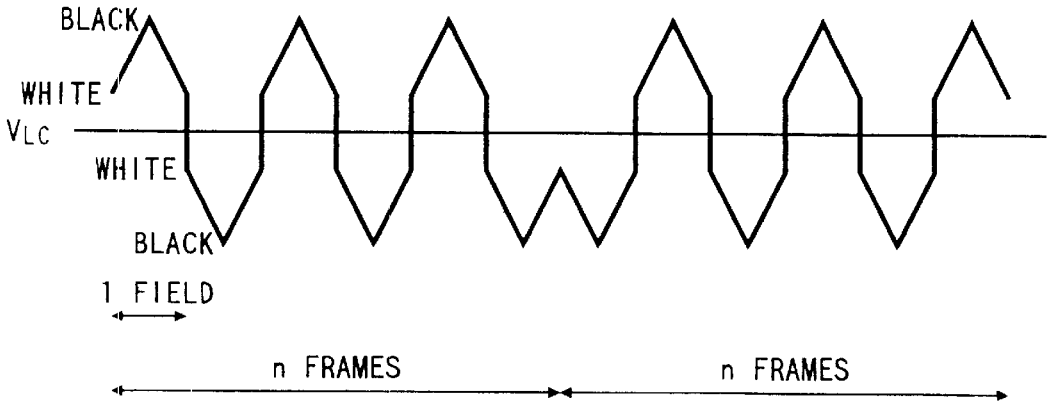
Figure 3:
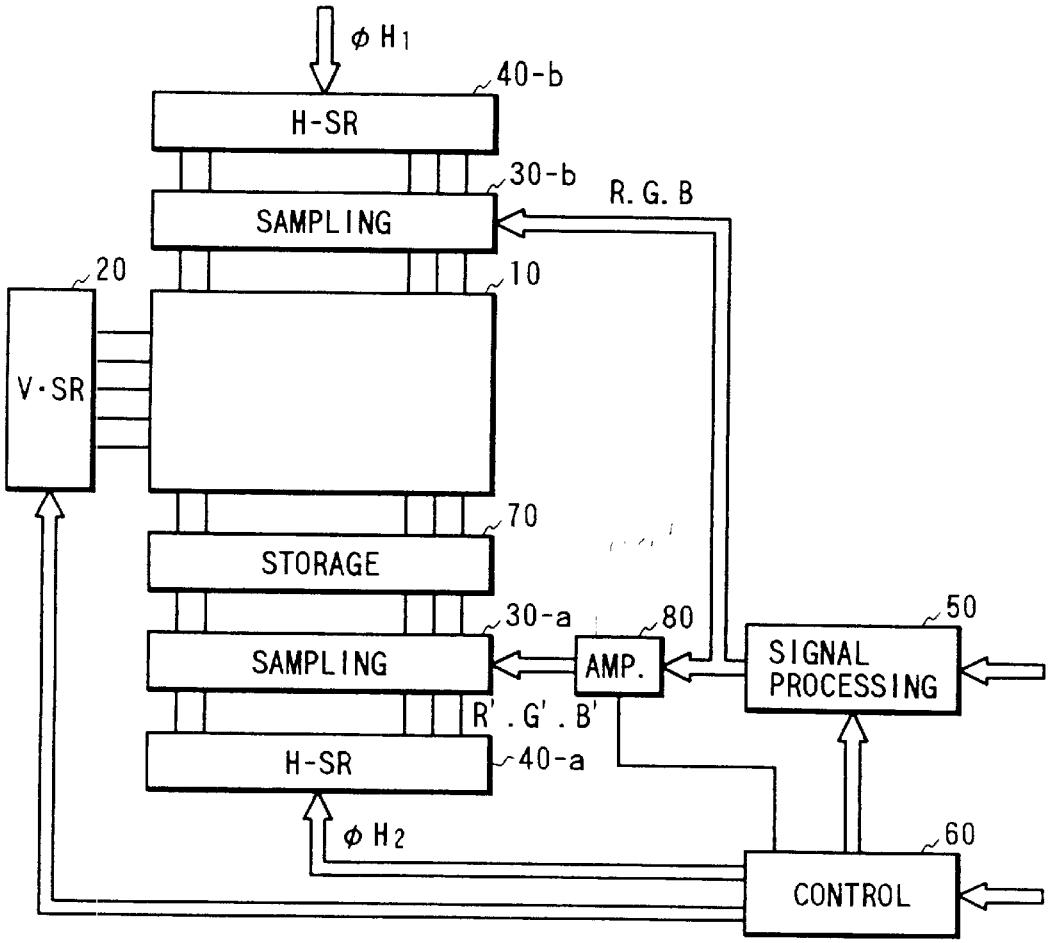
FIG. 3 is a block diagram of a circuit in which image signal input units of two systems are provided for a liquid crystal display.

An embodiment 1 relates to an example in which the invention is applied to the 2-row interpolation driving of a TFT type liquid crystal display in which pixels are arranged in a delta shape. In the embodiment, two image input circuits are provided for one vertical data line. FIG. 3 shows a flow of signals in the embodiment 1. In FIG. 3, reference numeral 30-*b* denotes a sampling circuit and 40-*b* indicates a horizontal scanning circuit which construct a first image input circuit. Reference numeral 30-*a* denotes a sampling circuit; 40-*a* a horizontal scanning circuit; and 70 a temporary storage circuit. Those circuits construct a second image input circuit. Reference numeral 50 denotes a signal processing circuit which is divided to a system to directly lead a color signal to the sampling circuit 30-*b* and a system to lead the color signal to the sampling circuit 30-*a* through an inverting amplifier 80. The same component elements as those shown in FIGS. 1A and 1B are designated by the same reference numerals and their descriptions are omitted here.

Figure 4:
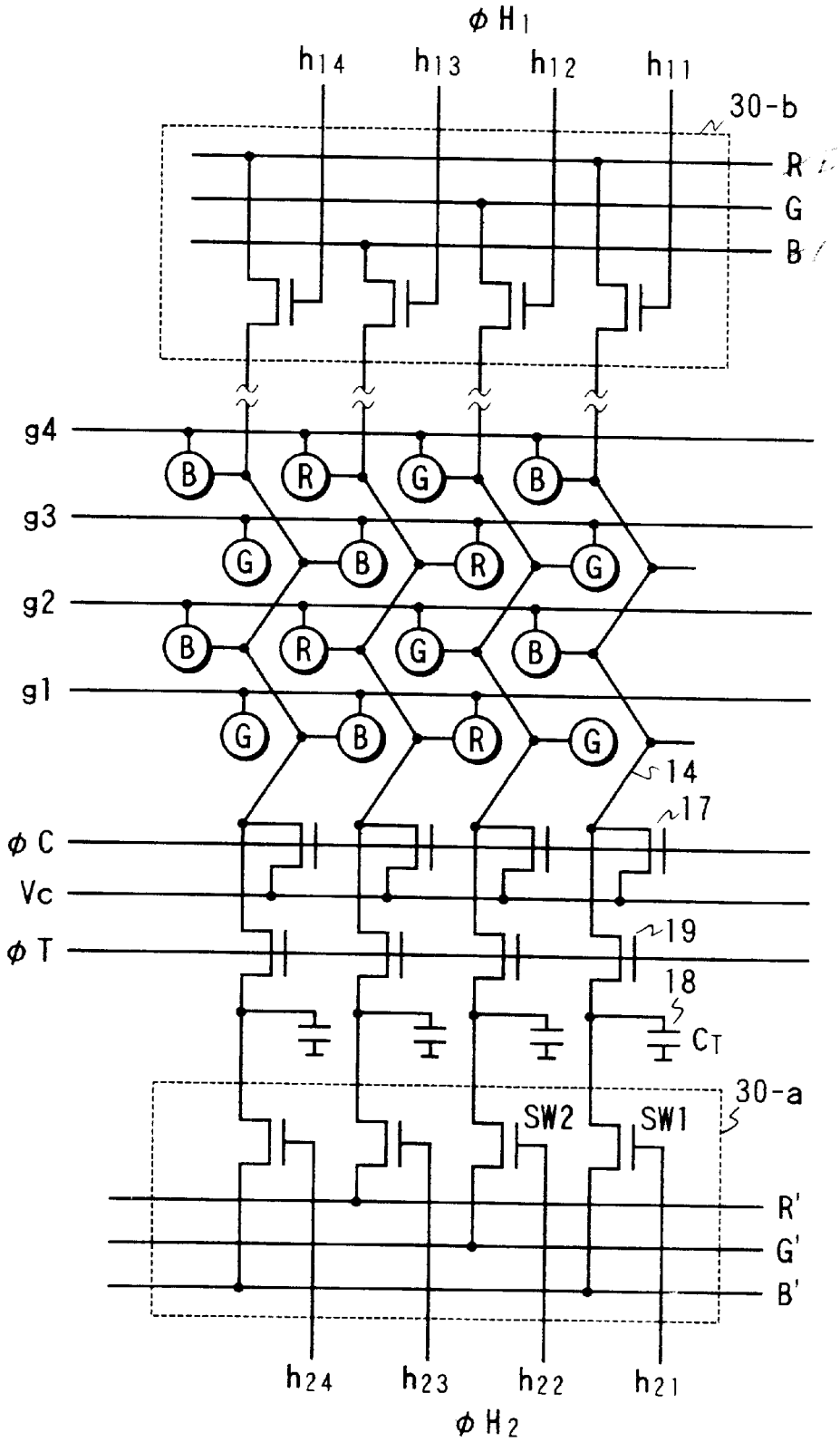
FIG. 4 is a detailed diagram of a display pixel unit, a storage circuit, and a sampling circuit.

FIG. 4 shows further in detail the display pixel section 10, sampling circuit 30, and storage circuit 70 of the color liquid crystal display. The same color pixels (for example, B) of the display pixel section 10 are arranged so as to be deviated by 1.5 pixels for the adjacent rows in order to form a delta array. In the embodiment, since two image signals are inputted to one vertical data line, the storage circuit 70 (FIG. 3) is a circuit for storing the image signals for a period of time during which the first image input circuit is performing the writing operation. The storage circuit 70 is generally constructed by a capacitor 18. In this case, there is also a situation such that when the signal stored in the capacitor 18 is written to each pixel through the vertical data lines 14, a capacitive division occurs due to a parasitic capacitance of the vertical data lines 14 and a signal amplitude deteriorates.

In the embodiment, the apparatus further has: a reset transistor 17 to return the vertical data lines 14 to a reference potential (Vc); the switching transistors (sw1, sw2, . . . ) each for deciding a timing to write the image signals to the capacitor 18; and a transfer transistor 19 for transferring the signals of the capacitor 18 to each pixel through the vertical data lines 14.

Figure 5:
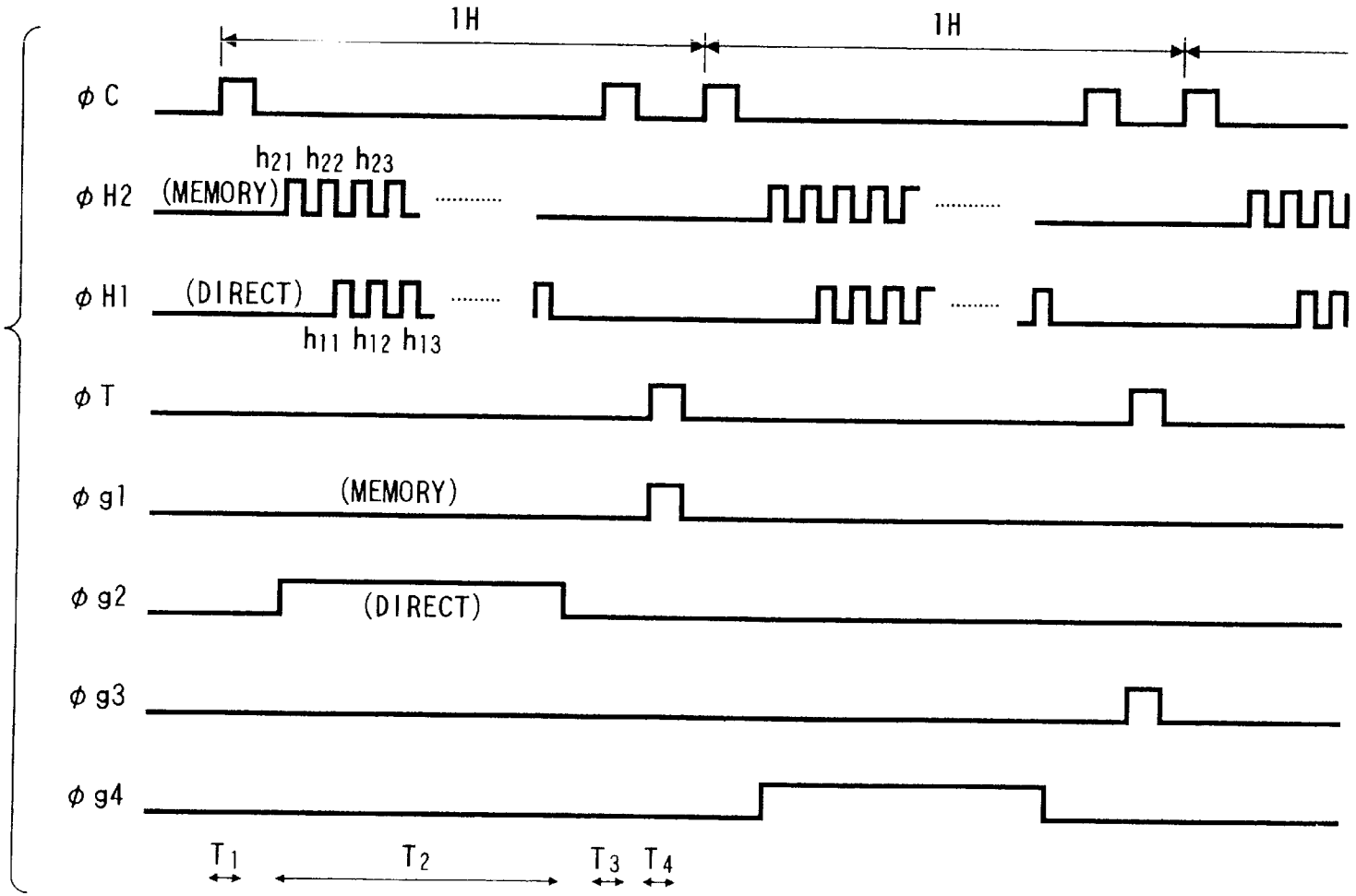
FIG. 5 is a timing chart for an image signal input.

FIG. 5 is a timing chart of the embodiment. When each pulse shown in the diagram is at the "H" level, the corresponding transistor is turned on. The reset transistor 17 is turned on by a pulse ϕc for a T1 period and the vertical data lines 14 are reset to the reference potential Vc. Subsequently, at a T2 period, the color image 1H signal of odd1 is directly written to each pixel of the row g2 by a horizontal scan pulse ϕH1 (h11, h12, . . . denote sampling periods of the pixels) and the vertical pulse ϕg2. At a T3 period, the vertical pulse ϕg2 is set to the "L" level, the TFT corresponding to the pixel of the relevant row is turned off, and the signal written in the corresponding pixel is held. At the same T2 period, a color 1H signal $V_T$ of odd1 is written into the capacitor 18 in the storage circuit 70 by a horizontal scan pulse ϕH2 (h21, h22, . . . denote sampling periods of the pixels). At a T3 period, the reset transistor 17 is made conductive by the pulse ϕc, and the residual charges of the vertical data lines 14 are eliminated, and the vertical data lines 14 are reset to the reference potential Vc. The transfer transistor 19 is made conductive by a pulse ϕT at a T4 period, the TFTs corresponding to all of the pixels of the row g1 are turned on by the pulse ϕg1, and the color 1H signal $V_T$ of odd1 stored in the capacitor 18 is written to each pixel of the row g1. In this instance, since there is a fear such that the signal levels of the signals written to the row g1 drop due to the capacitive division or the like, it is preferable to provide an amplifier to the vertical data line 14. Deviations between the start timings of the pulses h21, h22, . . . and the pulses h11, h12, . . . corresponding to the pixels in the pulses ϕH1 and ϕH2 are set in consideration of the deviation of 1.5 pixels in the spatial arrangement of the same color signals between two rows.

The polarity of the image signal is inverted by the same pattern as that described in FIG. 13B. In the odd field, the signals of the same polarity are written to the adjacent two rows (rows g2 and g3; rows g4 and g5; . . . ) and the signal polarity is inverted every one horizontal scan (1H) (odd1, odd2, . . . ). In the even field, the signals of the opposite polarities are written to the adjacent two rows (rows g1 and g2; rows g3 and g4; . . . ) in which a combination is changed and the signal polarity is inverted every one horizontal scan (1H) (even1, even2, . . . ).

The embodiment has an n-frame inverting circuit for inverting the signal polarity every arbitrary n frames while performing the AC driving described above. FIG. 1B is the timing chart of the image signal when an attention is paid to a certain row (for example, row g2). It will be understood that although the image signal is inverted every field, the image signal is further inverted at a period of a large n-frame.

Figure 6:
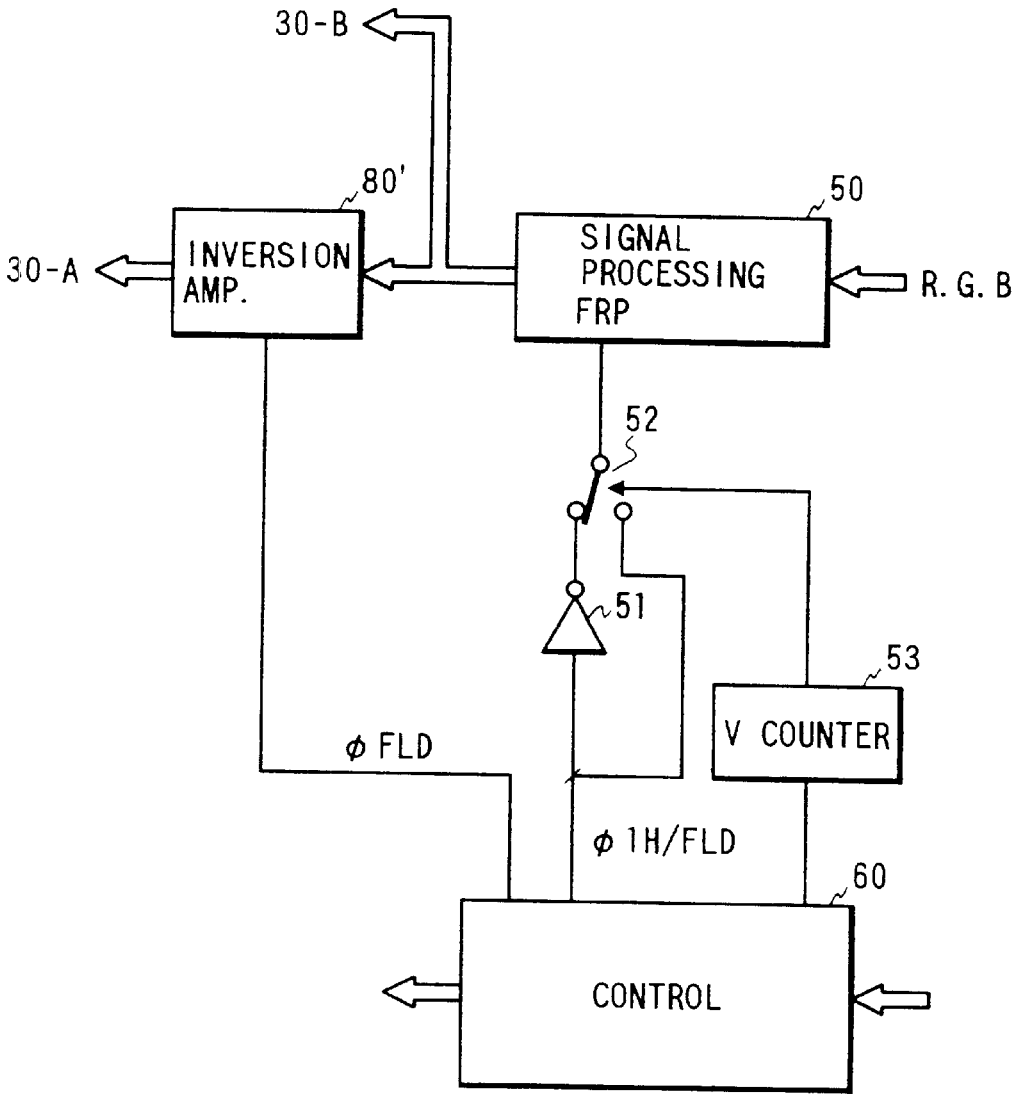
FIG. 6 is a block diagram of a circuit to execute an n-frame inversion.

FIG. 6 is a signal processing block for performing the n-frame inversion of the embodiment. Reference numeral 50 denotes the signal processing circuit; 60 the control circuit; 80' an inverting amplifier; 51 an inverter; 52 a switch; and 53 a V counter. The signal processing circuit 50 executes a gamma process for converting image signals (R, G, B) to signals in consideration of the input/output characteristics of the liquid crystal. The signal processing circuit 50 forms the image signal that is inverted every 1H and one field by a pulse ϕ1H/FLD of 1H which is outputted by the control circuit and instructs the 1-field inversion. The image signal outputted from the signal processing circuit is directly inputted to the sampling circuit 30-*b* and is inverted by the inverting amplifier 80' and the inverted signal is inputted to the sampling circuit 30-*a*. The inverting amplifier 80' executes the non-inverting amplification in the odd field and performs the inverting amplification in the even field by a field pulse ϕFLD. Thus, the display pixel section 10 is set to the signal polarities as shown in FIG. 13B. By always using the inverting amplifier 80' as an inverting amplifier, the display pixel section 10 can be set to the signal polarities as shown in FIG. 13C. As will be understood by paying attention to a certain one row in FIG. 13C (for example, row g3), the signal polarities are also exchanged at 60 Hz in this case. When paying attention to any adjacent two rows (for example, rows g3 and g4 ), since they have a pair of positive polarity and negative polarity, the luminance transition caused by AC driving is averaged and it is easy to see.

The case of directly inputting the pulse ϕ1H/FLD and the case of inverting the pulse ϕ1H/FLD through the inverter 51 are exchanged by using the switch 52 every n fields counted by the V counter 53. By the above exchanging operation, the polarities of the image signals (R, G, B) are exchanged every 1H, one field, and n frames. Therefore, in the embodiment, the DC components as shown in the rows g3 and g6 in FIG. 15B are exchanged every n frames, the liquid crystal is not burned.

Figure 7:
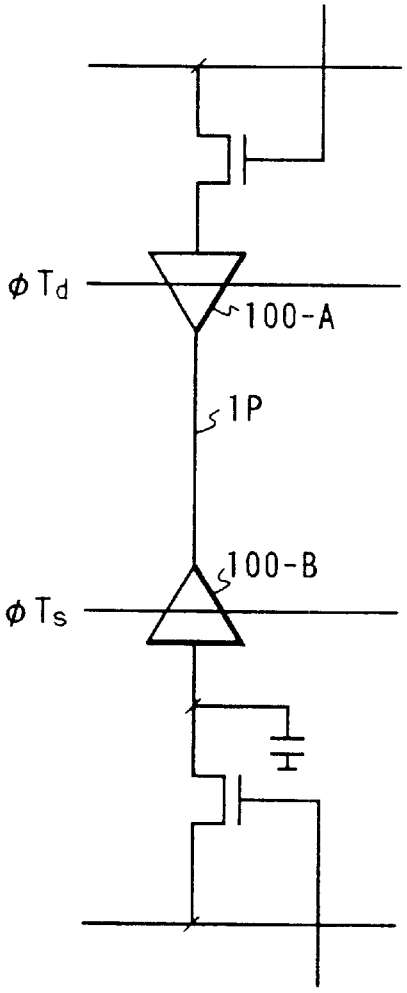
FIG. 7 shows an example of a buffer circuit.
Figure 8:
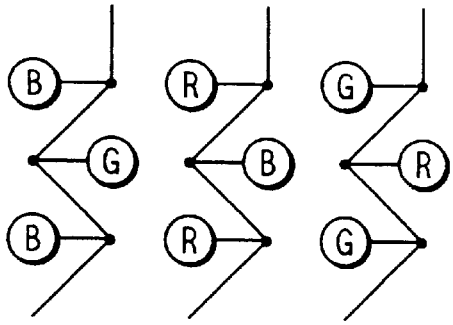
FIG. 8 shows an example in which different kinds of pixels are connected to the same data line.

Although the embodiment has been shown and described with respect to the 1-system memory method, a 2-system memory method can be also used or a buffer circuit can be also provided at the post stage of the memory as shown in FIG. 7. Although the same color pixels have been connected to one data line in the embodiment, when pixels of various different colors are connected to one data line as shown in FIG. 8, it is sufficient to change scanning timings. In a monochromatic liquid crystal display device without any color filter, it is sufficient to perform the signal control for a monochromatic color. Although the above embodiment has been described with respect to the example in which the n-frame inversion is further executed in the 1H/1 field inverting system, the invention can be also similarly applied to an inverting system as shown in FIG. 1B so long as it executes the field deviation driving such that a plurality of rows to be combined are changed every field.

In the embodiment, a display to write the color signals which are outputted from the signal processing circuit 50 to two rows at different timings in a series of one horizontal scan (1H) periods as shown at T1 to T4 in FIG. 5. Therefore, as compared with the two-row simultaneous driving method, the number of sampling times of the image signal is doubled, so that the resolution is improved and a moire due to an aliasing distortion of the sampling can be also reduced. Since the signal polarities are inverted as shown in FIG. 13B, when attention is paid to one row, the inversion signal is written every field (60 Hz), so that a flickering which is conspicuous for the human eyes does not occur.

[Embodiment 2]

The embodiment 2 relates to an example in which the invention is applied to the 2-row simultaneous driving of an STN type liquid crystal display of a simple matrix wiring in which pixels are arranged in lines. In the embodiment 2, one image input circuit is provided for one data line. FIG. 1A shows a signal processing block diagram for performing the n-frame inversion of the embodiment. A display section 1 includes the display pixel section, horizontal scanning circuit, vertical scanning circuit, and the like. The control circuit 60 generates a pulse ϕFRP to invert the signals every 1H and one field, thereby inverting the image signals (R, G, B) every 1H and one field. The case of inputting the pulse ϕFRP without inverting and the case of inverting the pulse ϕFRP through the inverter 51 and inputting are exchanged by using the switch 52 every n fields counted by the counter 53. By the above operation, the polarities of the image signals (R, G, B) are exchanged every 1H and one field and n frames. For example, they are inverted every 30 frames as n frames. For this purpose, the counter 53 counts 60 fields and alternately exchanges a pulse ϕV which is generated from the control circuit to the in-phase and opposite phase of ϕFRP every 60 fields (one minute).

In the embodiment as well, since the DC components as shown in the rows g3 and g6 in FIG. 15B are exchanged every n frames, the liquid crystal is not burned. In the embodiment, since the same image signal is inputted to the pixels locating at the same column in two rows, a simple matrix wiring of a simple structure can be used without using any switching element or the like. Therefore, the whole manufacturing costs are cheap. Although the embodiment has been described with respect to the STN type liquid crystal display of the simple matrix wiring in which the pixels are arranged in lines, any one of the displays which can perform the 2-row simultaneous driving can be used in the embodiment. For example, the liquid crystal material is not limited to the super twisted nematic liquid crystal (STN) but can also use a twisted nematic liquid crystal (TN) or a ferroelectric liquid crystal (FLC). The wiring is not limited to only the simple matrix wiring but can also use an active matrix wiring using a switching element of two or three terminals.

[Embodiment 3]

The embodiment 3 relates to a display example of a panel in which the number of rows of a display pixel section is only ½ of the number of scan lines of the image signal. In a manner similar to the embodiment 2, only one image input circuit is provided for one data line. A TFT type LCD is used as a display. When the image signals are inputted to the display pixel section, although the vertical scanning circuit has sequentially selected every two rows in the embodiment 2, the vertical scanning circuit sequentially selects only every row in the embodiment 3. Since the switching transistor is provided for each pixel in the embodiment 3, the pulse that is outputted from the vertical scanning circuit is the pulse to turn on the switching transistor. The other driving method is substantially the same as that of the embodiment 2. The image signals are inverted every 1H and one field and n frames by using the circuit as described in FIG. 1A.

Figure 16A:
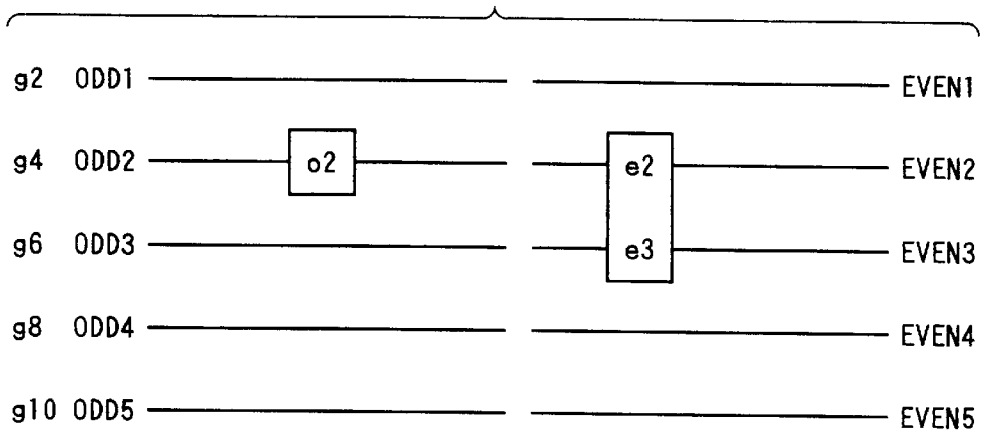
FIGS. 16A and 16B show images FIG. 16A when the NTSC signal including the white still image is displayed on a display in which the number of rows of a display pixel section is only ½ of the number of scan lines and also shows a voltage waveform FIG. 16B of each row.
Figure 16B:
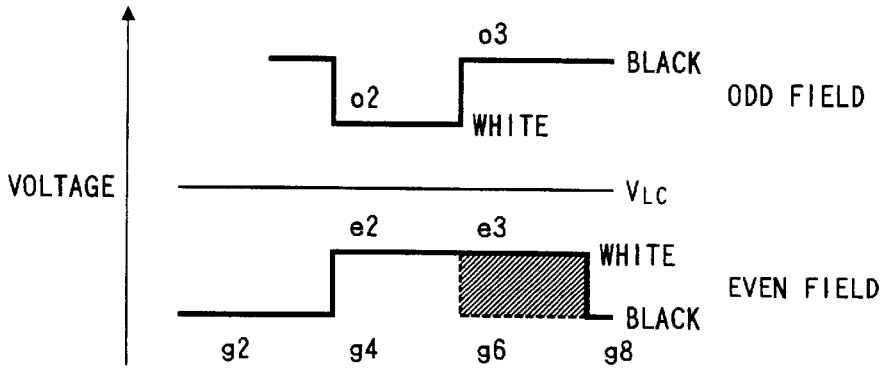
PRIOR ART FIG. 16B

According to the embodiment 3, since the DC component as shown in the row g6 in FIG. 16B is exchanged every n frames, the liquid crystal is not burned. Although the embodiment 3 has been described with respect to the case of using the TFT type LCD as a display, any other LCD of the MIM type or simple matrix type can be also used.

[Embodiment 4]

Figure 9:
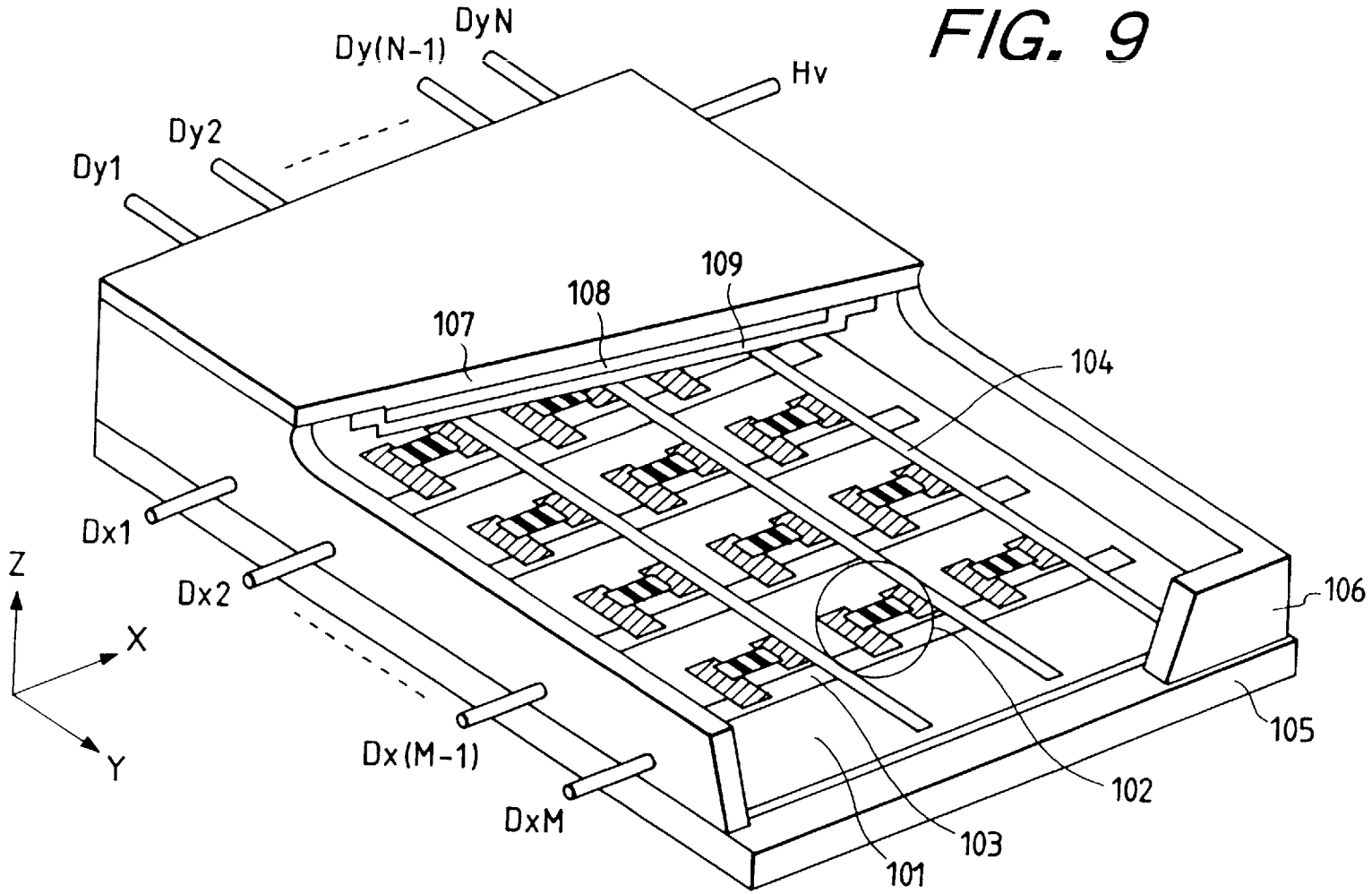
FIG. 9 is a perspective view of an electron beam flat display.
Figure 10A:
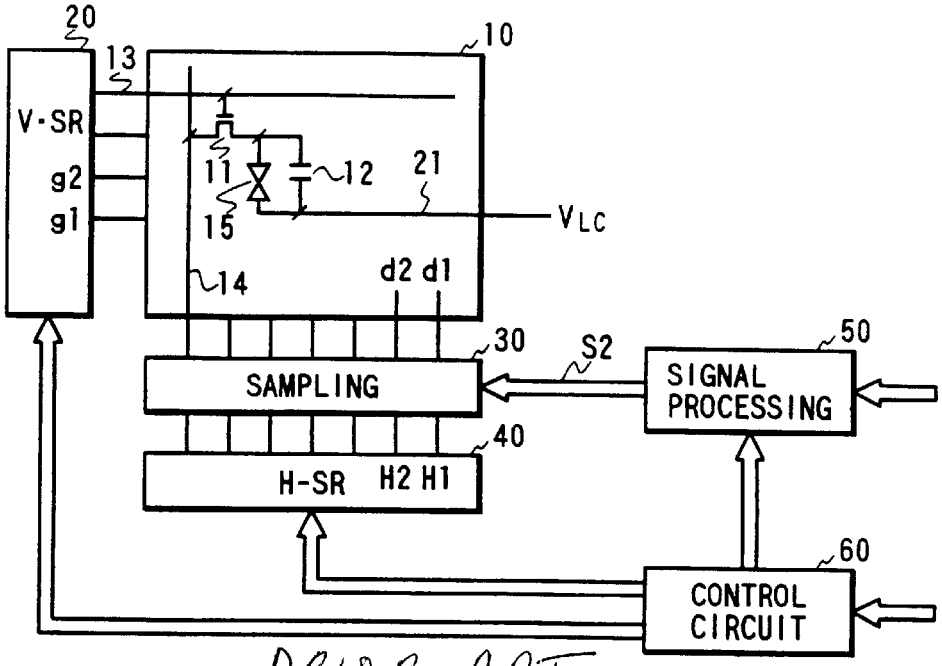
FIGS. 10A and 10B show block diagrams FIG. 10A of an image signal input circuit of a liquid crystal display and a detailed diagram FIG. 10B of a display pixel unit and a sampling circuit.
Figure 10B:
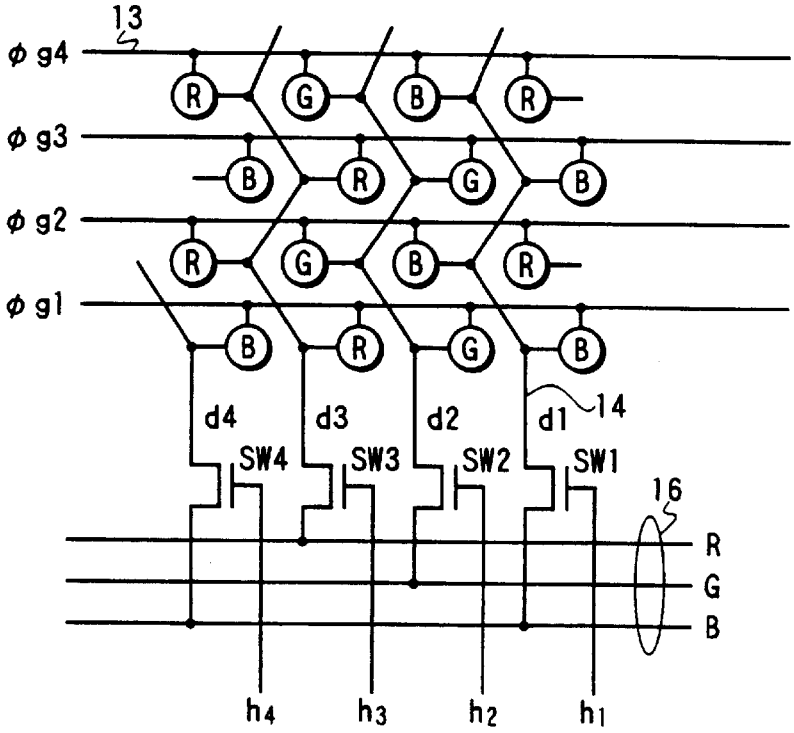
PRIOR ART FIG. 10B
Figure 11A:
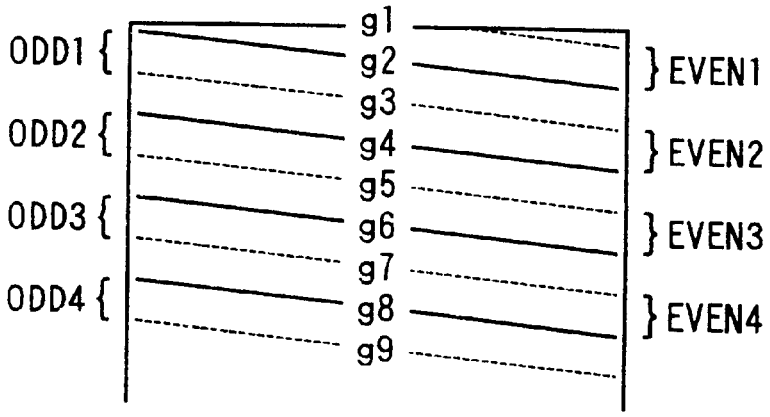
FIGS. 11A and 11B show examples in which an image signal is scanned on the display.
Figure 11B:
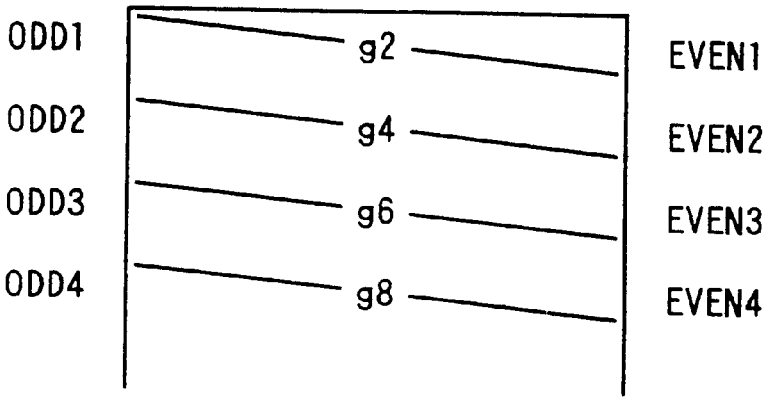
PRIOR ART FIG. 11B
Figure 12:
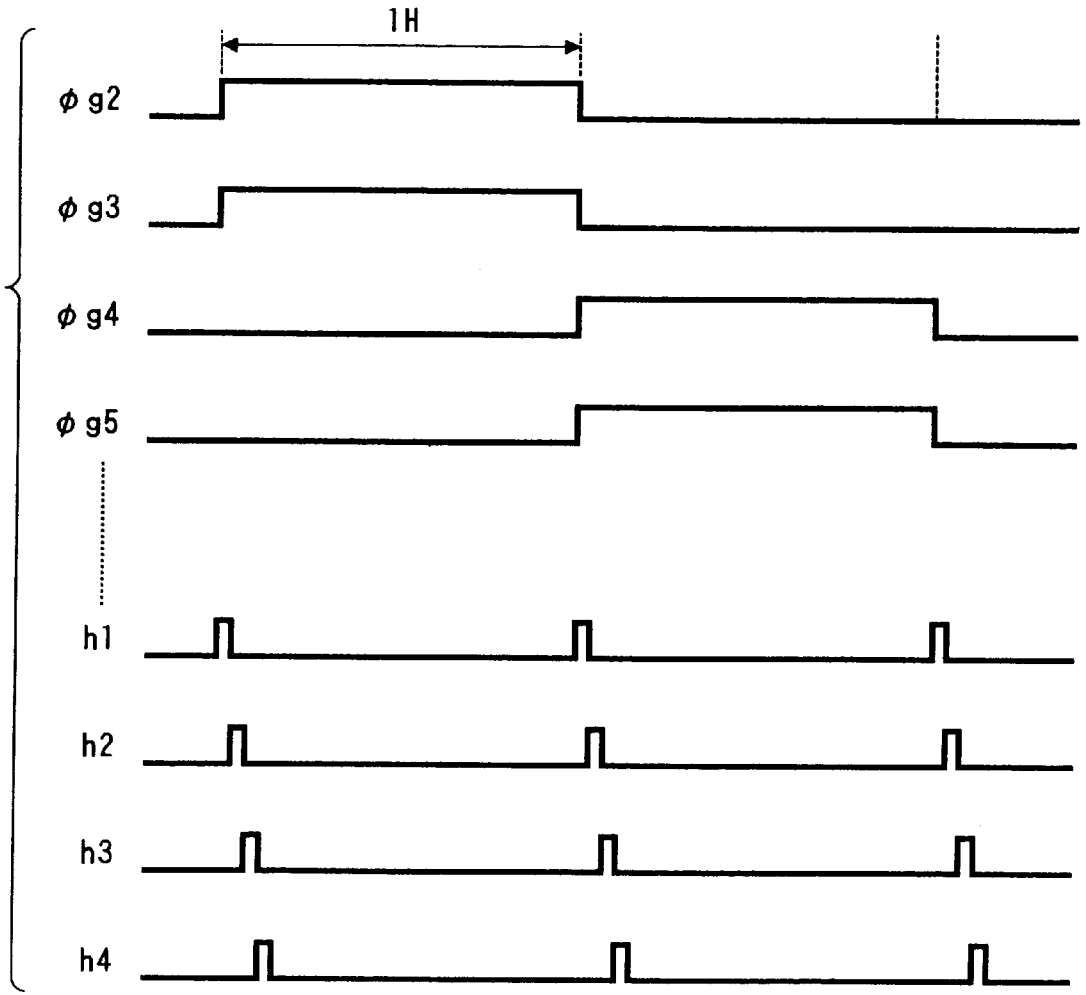
FIG. 12 PRIOR ART
FIG. 12 is a timing chart for the 2-row simultaneous driving.
Figure 14:
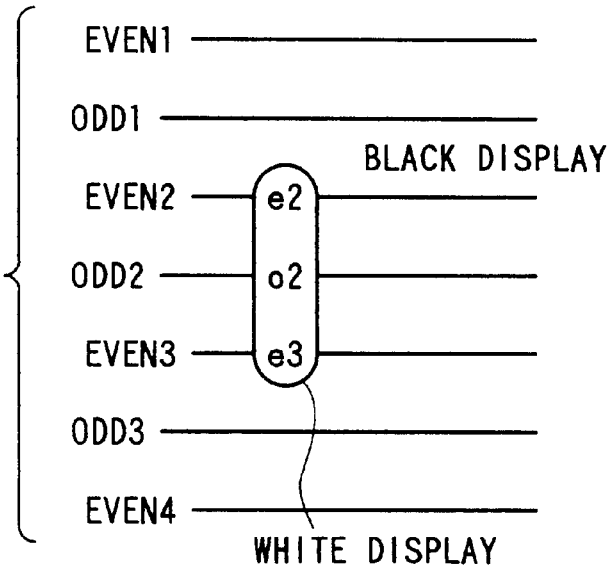
FIG. 14 shows an image on the display when an NTSC signal including a white still image is interlace scanned at a high fidelity.

The embodiment 4 relates to an example in which the invention is applied to the electron beam flat display. As a display, a flat panel in which each pixel has an electron source and which has a fluorescent plate for exciting and emitting the light by electrons which are emitted from the electron sources is used. FIG. 9 simply shows such an electron beam flat display. In the diagram, reference numeral 105 denotes a rear plate; 106 a barrier; and 107 a phase plate. An airtight vessel is constructed by those component elements and the inside of the display is maintained at a vacuum state. Reference numeral 101 denotes a substrate; 102 an electron source; 103 a row direction wiring; and 104 a column direction wiring. Those component elements are fixed to the rear plate 105. Reference numeral 108 denotes a fluorescent material and 109 indicates a metal back which are fixed to the phase plate 107. By colliding electrons to the fluorescent material 108, the electron source 102 excites the fluorescent material 108 and emits the light. As a fluorescent material, a material which emits three primary colors of red, blue, and green is arranged. The metal back 109 functions to improve the light using efficiency by mirror reflecting the light emitted from the fluorescent material 108, to protect the fluorescent material 108 from the collision of the electrons, and to accelerate the electrons by being applied with a high voltage from a high voltage input terminal Hv. There are (M×N) electron sources 102 as a whole (M electron sources in the vertical direction and N electron sources in the horizontal direction). Those electron sources are connected by the M row direction wirings 103 and the N column direction wirings 104 which perpendicularly cross each other. Dx1, Dx2, . . . , DxM denote input terminals of the row direction wirings. Dy1, Dy2, . . . DyN denote input terminals of the column direction wirings. The row direction wirings 103 become data wirings. The column direction wirings 104 become scan wirings.

Even in such an electron beam flat display, the 2-row simultaneous driving as shown in the embodiment 2 or the driving as shown in the embodiment 3 in which the number of rows is equal to only ½ of the number of scan lines of one frame of the image signal can be executed. By exchanging the case where the pulse ϕFRP is inputted and the case where the pulse ϕFRP is inverted through the inverter 51 by using the switch 52 every n fields counted by the counter 53 as described in FIG. 1A of the embodiment 2, the polarities of the image signals are exchanged every 1H and one field and n fields. Therefore, even when a still image is inputted, the device is not deteriorated.

What is claimed is:

1. A liquid crystal apparatus comprising:

a liquid crystal panel comprising a plurality of pixels which are arranged along a plurality of rows and columns and each of which comprises a pair of electrodes opposed to each other and a liquid crystal disposed between the pair of electrodes, horizontal scanning lines connecting each row through a common wiring, and vertical data lines connecting each column through a common wiring;

a drive circuit comprising a vertical scanning circuit for driving said horizontal scanning lines and a horizontal scanning circuit for driving said vertical data lines, so that said vertical scanning circuit is driven to select a row, and said horizontal scanning circuit is driven to supply the plurality of pixels along the selected row through said vertical data line with a data signal voltage; and a control circuit for controlling said drive circuit during an odd field period and an even field period, such that voltage polarities of the data signal voltages supplied to the pixels adjacent to each other along the selected row are opposite to each other, so that voltage polarities of the data signal voltages supplied to the pixels adjacent to each other along a column are opposite to each other, the voltage polarity of the data signal voltage supplied to one pixel is inverted per each field period, and the voltage polarity of the data signal voltage supplied to one pixel is further inverted per predetermined number n of frames.

2. A liquid crystal apparatus according to claim 1, wherein said pixel is provided with a switching element.

3. A liquid crystal apparatus comprising:

a liquid crystal panel comprising a plurality of pixels which are arranged along a plurality of rows and columns and each of which comprises a pair of electrodes opposed to each other and a liquid crystal disposed between the pair of electrodes, horizontal scanning lines connecting each row through a common wiring, and vertical data lines connecting each column through a common wiring;

a drive circuit comprising a vertical scanning circuit for driving said horizontal scanning lines and a horizontal scanning circuit for driving said vertical data lines, so that said vertical scanning circuit is driven to select a row, and said horizontal scanning circuit is driven to supply said plurality of pixels along the selected row through said vertical data line with a data signal voltage; and a control circuit for controlling said drive circuit during an odd field period and an even field period, such that the voltage polarities of the data signal voltage supplied to pixels adjacent to each other along the selected row are the same, such that the voltage polarities of the data signal voltages supplied to the pixels adjacent to each other along the column are opposite to each other, such that the voltage polarity of the data signal voltage is inverted per each field period, and such that the voltage polarities of the data signal voltage supplied to the pixel are further inverted per a predetermined number n of frames.

4. A liquid crystal apparatus according to claim 3, wherein said pixel is provided with a switching element.

* * * * *

UNITED STATES PATENT AND TRADEMARK OFFICE

CERTIFICATE OF CORRECTION

PATENT NO. : 6,570,553 B2
DATED : May 27, 2003
INVENTOR(S) : Seiji Hashimoto et al.

It is certified that error appears in the above-identified patent and that said Letters Patent is hereby corrected as shown below:

Column 1,
Line 20, “an” should be deleted.
Line 28, “LCD is,” should read -- LCD, --.

Column 2,
Line 30, “a” should be deleted.

Figure 15A:
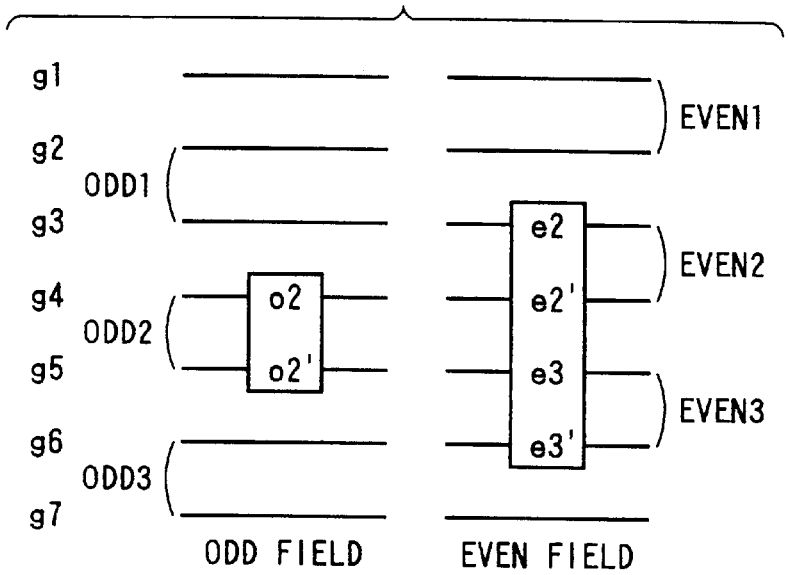
FIGS. 15A and 15B show images FIG. 15A on the display when the NTSC signal including a white still image is 2-row simultaneous driven or is 2-row interpolation driven and also shows a voltage waveform FIG. 15B of each row.
Figure 15B:
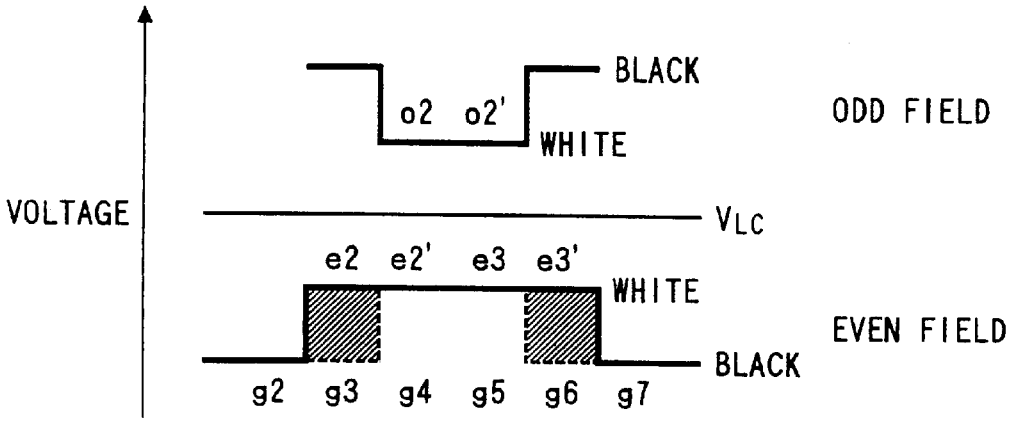
PRIOR ART FIG. 15B

Column 6,
Line 24, “FIG. 15A” should be deleted.
Line 27, “shows” should read -- show --; and “FIG. 15 B” should be deleted.
Line 28, “FIG. 16A” should be deleted.
Line 31, “shows” should read -- show --.
Line 32, “”FIG. 16B” should be deleted.

Column 10,
Line 6, “are” should read -- is --.
Line 42, “opposed” should read -- opposed to --.

Column 12,
Line 12, “is” should read -- are --.

Signed and Sealed this

Tenth Day of February, 2004

JON W. DUDAS
*Acting Director of the United States Patent and Trademark Office*